United States Patent [19]

Fan

[11] Patent Number: 4,716,634

[45] Date of Patent: Jan. 5, 1988

[54] TWO-PIECE REINFORCED CLOTHES PEG

[76] Inventor: Wen-Yuan Fan, No. 6, Lane 37, Jih Hsin Street, Tu Chen Hsiang, Taipei Hsien, Taiwan

[21] Appl. No.: 46,901

[22] Filed: May 5, 1987

[51] Int. Cl.[4] ..... A41D 27/22

[52] U.S. Cl. ..... 24/545; 24/501; 24/542; 223/91

[58] Field of Search ..... 24/545, 542, 501, 530, 24/562, 563, 564, 489, 502; 223/85, 91

[56] References Cited

U.S. PATENT DOCUMENTS

| | | | |
|---|---|---|---|
| 1,684,721 | 9/1928 | Wood | 24/501 |
| 3,137,027 | 6/1964 | Birkle | 24/542 |
| 4,335,838 | 6/1982 | Bisk et al. | 223/91 |
| 4,382,531 | 5/1983 | Bisk et al. | 223/91 |
| 4,605,978 | 8/1986 | Beavin | 24/545 |
| 4,638,930 | 1/1987 | Blanchard | 24/545 |
| 4,660,750 | 4/1987 | Blanchard | 223/91 |

*Primary Examiner*—Victor N. Sakran
*Attorney, Agent, or Firm*—Browdy and Neimark

[57] ABSTRACT

The present disclosure is concerned with a two piece reinforced clothes peg which is mounted on the transverse rod of a clothes horse, and consists of a pair of jaw members, joined together along one common edge thereof, and a J-shaped clamping member which is detachably engaged with the paired jaw members on the surface of which there are defined properly shaped niches for receiving the legs of the clamping member so that the jaw members can become closely and tightly clamped together for holding a piece of hanged clothes firmly in place with the help of a plurality of projecting stripes defined on the inner surface thereof; and the clamped jaw members can be released by simply pushing upward the front enlarged flange of the J-shaped clamping member.

1 Claim, 11 Drawing Figures

TWO-PIECE REINFORCED CLOTHES PEG

SUMMARY OF THE INVENTION

The present invention relates to a two-piece reinforced clothes peg; generally placed on the transverse rod of a clothes horse, which consists of a right and left jaw members, joined together along the top edge thereof, the left jaw member 2 is provided with a restraint slat 24 and a niche 25 is defined thereunder; furthermore there are two symmetric openings 21 planted near the top side thereof in which a J-shaped hook 22 is received respectively for the purpose of attaching the same to the transverse rod of a clothes horse; on the external surface of the right jaw member 1, there is similarly provided with a niche 11 having an enlarged oval shaped bottom portion 12; a J-shaped clamping member 3 of plastic steel material is located with its two legs located in said niches 11, 25 of the right and left jaw members 1, 2 respectively so that the jaw members can be tightly clamped together as a result of the resilient force exerted by the clamping member 3, therefore clothes or the like can be firmly held in place by means of the wavy projecting strips 131, 141 on the upper and lower protrusions 13 and 14 respectively on tne right jaw member 1, which are correspondingly disposed against the wavy projecting stripes 23 and two rows of projecting grains 26 planted on the left jaw member 2 so that the present clothes peg can be effective in firmly holding a piece of clothes or the like; when the J-shaped clamping member 3 is disengaged of its legs from the niches 11 and 25, the jaw members 1, 2 are released from a clamping state readily thereby. The present clothes peg is characterized in its firm, tight and secure clamping ability in one aspect and is free of rust in another.

In a conventional clothes peg or pin, the jaw members are joined together to form a V-shaped structure and a spring element is adopted to produce a clamping force thereon so that a piece of clothes can be held in place, however the contact area and clamping force are not sufficient enough to surely hold a hanged clothes firmly in place in a windy or vibratory situation.

Therefore, it is the primary object of the present invention to provide a two-piece clothes peg consisting of a pair of jaw members which are jointed together on the top edge thereof and are provided with a niche on the external surface thereof respectively and a plurality of projecting stripes on the internal surfaces thereof so that a better clamping effect can be achieved with the help of a J-shaped clamping member which can be removably in registration with the paired jaw members in use, and be disengaged from the same when the clothes peg is intended to be released.

The further object of the present invention is to provide a two-piece clothes peg made of plastics which is characterized in a pair of jaw members and a J-shaped clamping member which is structured to have a pair of legs, one short and one long, with the short leg having a gradually expanded head portion, and the joint of the two legs is so defined that the same are positioned as closely side by side as possible so to provide the clamping member with a resilient clamping ability.

In order to make the preent clothes peg described in a more understandable manner of its structure and operation mode, a number of drawings are provided along with a detailed description of the preferred embodiments; in which:

DETAILED DESCRIPTION

Figure 3:
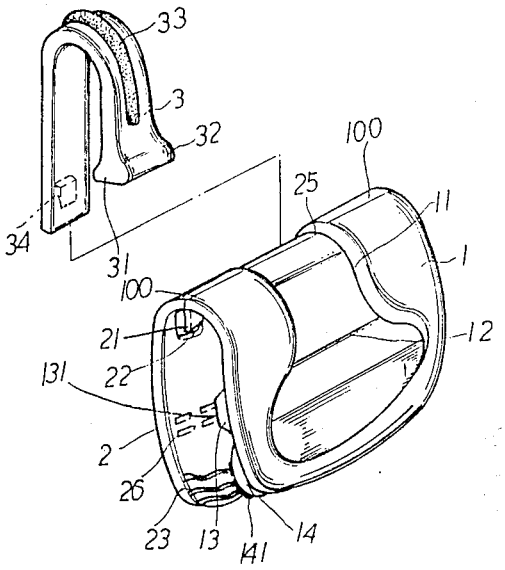
FIG. 3 is an exploded view of the present clothes peg.
Figure 4:
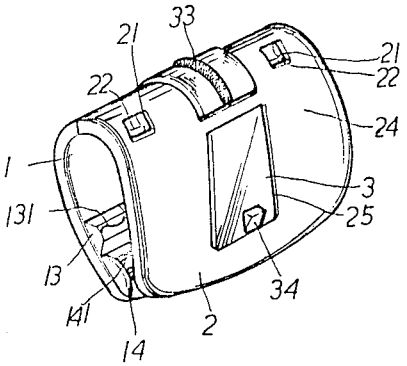
FIG. 4 is another perspective view showing the other side of the present clothes peg.

Referring first to FIG. 3, the present clothes peg consists of a right jaw member 1, a left jaw member 2 and a J-shaped clamping member 3, said right jaw member 1 is arcuately shaped and a pair of parallel projecting belt-like portions 13, 14 are provided on the internal surface and near the bottom thereof for the purpose of firmly holding the object inserted therein, on said belt-like portions 13, 14, there are planted at least one or more wavy projecting stripes 131, 141 to effect the afore-mentioned grasping ability; on the external surface of said jaw member 1, there is provided a niche 11 which is configured to have an oval-shaped bottom portion 12 so that said J-shaped clamping member 3 can be in locking engagement therewith; on the top edge of said jaw member 1, there are two connecting portions 100 adapted so to integrate said jaw members 1, 2 together.

Said left jaw member 2 is configured to have a straight back portion which extends to the top thereof and is curved at the top end so to facilitate the integration with said right jaw member 1 by means of said connecting portions 100; and a transversely-located restraint slat 24 is provided on the external surface of said left jaw member 2 with a niche 25, disposed thereunder extending from the top edge to the bottom thereof, and said niche 25 is symmetrically planted in accordance with said niche 11 of said right jaw member 1 so that said J-shaped clamping member 3 can be in engaging relation with said two jaw members. A pair of symmetrically positioned openings 21 are defined on each side of said niche 25 respectively, in each of which a J-shaped hook 22 is provided so to attach the assembled clothes peg to the transverse rod of a clothes horse; to match with said projecting wavy stripes 131, 141 planted on said right jaw member 1, there are correspondingly difined projecting grains 26 and wavy stripes 23 as shown in FIGS. 7 and 8.

Figure 1:
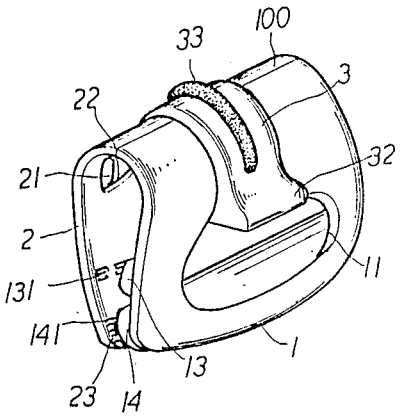
FIG. 1 is a perspective view showing the present clothes peg being in a closed position.
Figure 2:
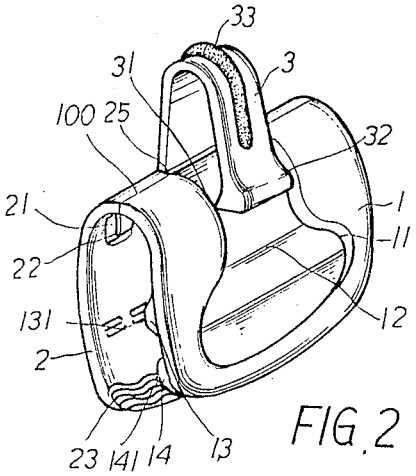
FIG. 2 is a perspective view showing the present clothes peg being in an opened position.

Said clamping member 3 is structured to have a reinforcement ridge 33 along the external surface thereof, and a wedge-shaped projection 34 is furnished near the bottom end of the long leg for preventing the clamping member from disengaging from the jaw members 1, 2 as it is limited by said transverse restraint slot 24; on the opposite short leg of said clamping member 3, an enlarged end portion is formed to have a pair of symmetric flanges 31 and 32, the former is defined to properly engage within said oval-shaped bottom portion 12, and the latter is for ready operation on said clamping member 3 to push the same upward or downward as shown in FIGS. 1, 2.

Figure 5A:
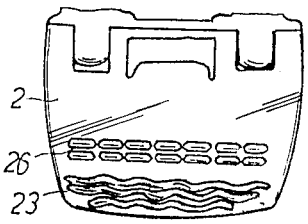
FIG. 5 is a combination view showing the internal surface of the left jaw member.
Figure 5B:
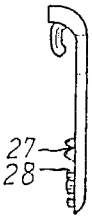
Figure 6A:
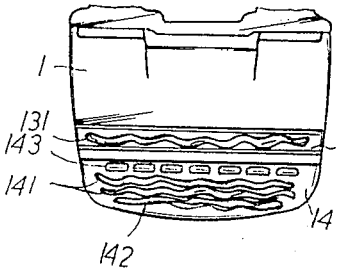
FIG. 6 is a combination view showing the internal surface of the right jaw member.
Figure 6B:
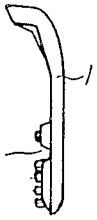

As shown in FIG. 5, the internal surface of said left jaw member 2 is planted with more than two equally spaced projecting wavy stripes 23 near the bottom edge thereof, and a pair of or more rows of parallelly projecting grains 26 are disposed above said stripes 23, and the distance 27 between said linearly positioned grains is smaller than the distance 28 between said wavy stripes 23 and said projecting grains. As further shown in FIG. 6, a right-side and sectional view of said right jaw member 1 is provided to illustrate the disposition of two belt-like projections 13, 14 which are planted with wavy stripes 131 and 141 thereon; and a stripe 142 having larger dimension tha stripes 141 is planted right below said stripe 141 and a row of projecting grains 143 is disposed right above said wavy stripes 141; and the distance between said belt-like projections is equal to said distance.

Figure 7:
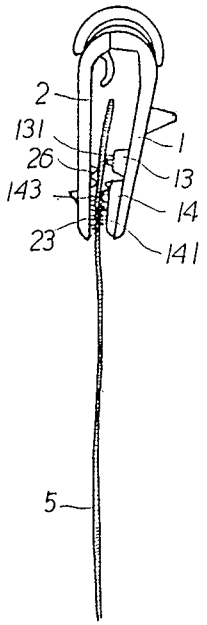
FIG. 7 is a sectional view of an opened clothes peg of the present invention.
Figure 8:
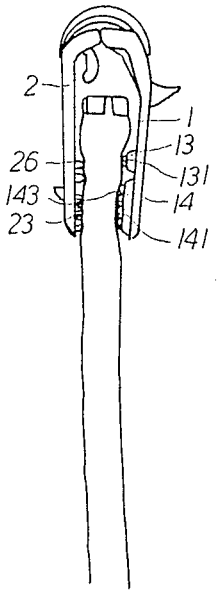
FIG. 8 is a sectional view of a closed clothes peg of the present invention.
Figure 9:
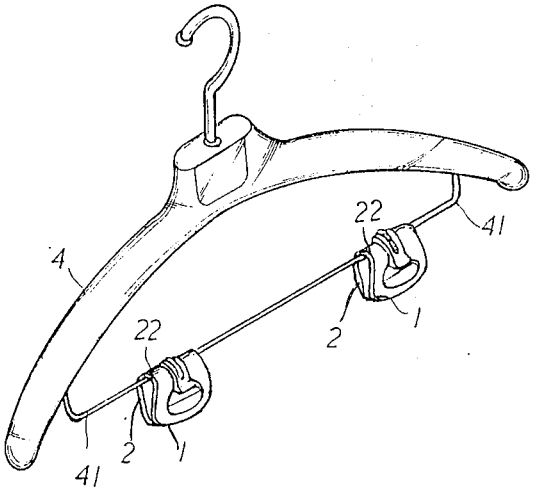
FIG. 9 is a practical application of the present clothes pegs mounted on a transverse rod of a clothes horse.

With further reference to FIGS. 7, 8, 9, said jaw members 1, 2 are manufactured by integral molding of plastic material or the like; in assembly, said clamping member 3 is mounted on said jaw members by locating the long leg thereof through said restraint slat 24 and partially into said niche 25 as shown in FIG. 2. In practical operation, corners of a piece of clothes 5 or the like are first inserted into the mouth of the present clothes peg, then the flange 32 is actuated by fingers to make said clamping member 3 move downward and become tightly engaged with said jaw members 1, 2 which are forced thereby to tightly press against each other and said clothes is then firmly held in place by means of said projecting stripes as 23 131. 141 and grains 26, 143 on the internal surface of said jaw members 1, 2. Owing to the proper design of the clamping member 3, the same can be tightly engaged within said niches 11, 25 without any possibility of disengagement therefrom in use. The release of the tightened clothes peg can only be effected by simply pushing said flange 32 upward so to disengage said clamping member 3 from the jaw members 1, 2.

Moreover, the present clothes peg can be readily attached to the transverse rod 41 of a clothes horse 4 by simply inserting the rod into the mouth of said peg and positioning the rod on the hooked portion of said J-shaped hook 22 housed in said openings 21 of said jaw member 2 as shown in FIG. 5.

I claim:

1. A two-piece reinforced clothes peg comprising:

a right jaw member 1, arcuately configured at the top portion, and in the internal surface thereof being provided with two-parallel belt-like projections 13, 14 on which respectively are planted projecting wavy stripes 131, 141 for effecting the purpose of firm clamping of a piece of hanged clothes; on the external surface a niche 11 having an oval-shaped bottom portion 12 being defined, for receiving therein one leg of a clamping member when the same is in registry with the clothes peg; and a pair of connecting portions 100 being disposed along the top edge of said right jaw member;

a left jaw member 2, coupled to said right jaw member 1 by means of said connecting portions 100, being configured to have a straight back portion terminating with an arcuate-shaped top end, and a niche 25 being defined in correspondence to said niche 11 of said right jaw member 2; and a restraint slat 24 being provided near the top of said niche 25 for the purpose of locating said clamping member 3 in place; in order to secure the present clothes peg to the transverse rod of a clothes horse 41, a pair of openings 21, each having a J-shaped hook 22 defined therein, being provided; and in the internal surface, a plurality of projecting wavy stripes 23 and projecting grains 24 being planted;

a J-shaped clamping member 3 made of plastic steel material having a pair of legs, one short and one long, and a wedge-shaped projection 34 being disposed, facing outward, on said long leg for securing the same to said jaw members by means of said restraint slat 24 planted on said left jaw member, and the short leg terminating with an enlarged end, having two-symmetrically-defined flanges 31, 32, the former being adopted to be able to be in secure engagement with the oval-shaped bottom portion 12 of said niche 11 so that said clamping member 3 is able to be fixed firmly in place in use, and the latter being set for ready puch operation of said clamping member 3; said long and short legs being slidably moved in said niches 25 and 11 respectively in operation, and a reinforcing ridge 33 being planted along the central line on the external surface of said clamping member 3; by means of above said components, the reinforced clothes peg being structured in such a manner that when in use, said clamping member 3 is pushed downward with its long leg and short leg moving in said niches 25, 11 of said left and right jaw members 2, 1 respectively, and said flange 31 of said short leg coming into engagement within said oval-shaped bottom portion 12 so that said clamping member 3 can be instantly in locking engagement with said jaw members, thereby forcing the jaw members to press against each other so to produce a clamping effect; by pushing upward said clamping member 3 to disengage said flange 31 from said oval-shaped bottom position 12, said left and right jaw members 2, 1 being free of a clamping state.

* * * * *